US006468195B1

(12) United States Patent
Jackson et al.

(10) Patent No.: US 6,468,195 B1
(45) Date of Patent: Oct. 22, 2002

(54) DEVICE FOR CONTINUOUS FOLDING OF FLAT MATERIAL

(75) Inventors: Barry Mark Jackson, York, ME (US); Joseph Adrian St. Ours, Lee, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/473,814

(22) Filed: Dec. 28, 1999

(51) Int. Cl.[7] ..... B31F 1/10
(52) U.S. Cl. ..... 493/443
(58) Field of Search ..... 493/443, 446, 493/454, 424, 299, 303, 402, 403

(56) References Cited

U.S. PATENT DOCUMENTS

| | | | | |
|---|---|---|---|---|
| 2,508,798 A | * | 5/1950 | Polsen et al. | 493/26 |
| 3,961,783 A | | 6/1976 | Beaudoin | 270/66 |
| 4,557,715 A | * | 12/1985 | Robinson | 493/224 |
| 4,579,552 A | * | 4/1986 | Brannlund | 493/116 |
| 5,037,365 A | | 8/1991 | Breton | 493/18 |
| 5,581,982 A | * | 12/1996 | Schroeder et al. | 53/459 |
| 5,692,740 A | * | 12/1997 | Holtje | 270/58.01 |

FOREIGN PATENT DOCUMENTS

| | | | |
|---|---|---|---|
| EP | 0434987 | 11/1983 | B65H/45/22 |
| GB | 2098587 | 11/1982 | B65H/5/02 |

* cited by examiner

*Primary Examiner*—John Paradiso
(74) *Attorney, Agent, or Firm*—Davidson, Davidson & Kappel, LLC

(57) ABSTRACT

The present invention is related to a device for continuous folding of flat material (14) such as signatures (14) being printed upon on a rotary printing press on one or both sides thereof. Said device according to the present invention includes a driven rotating body (3) such as a cylinder, arranged perpendicular to the conveying direction (37) of flat material (14), such as signatures. Said cylinder (3) rotates about its respective rotation axis (2), having surface sections (7, 8), respectively, assigned to its respective circumference, tapering towards each other upon revolution of the respective cylinder (3).

26 Claims, 6 Drawing Sheets

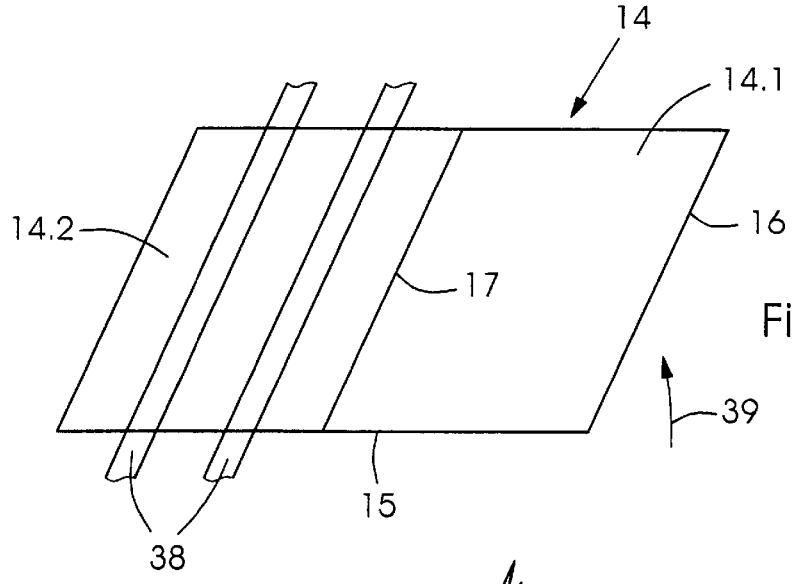
Fig.7.1
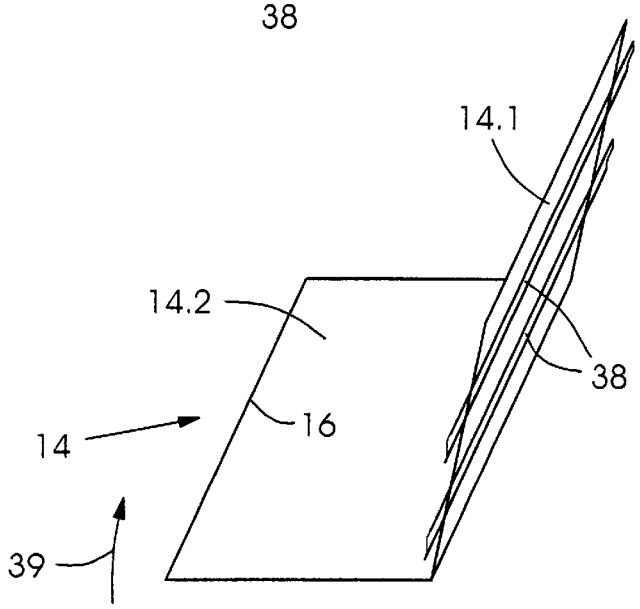
Fig.7.2
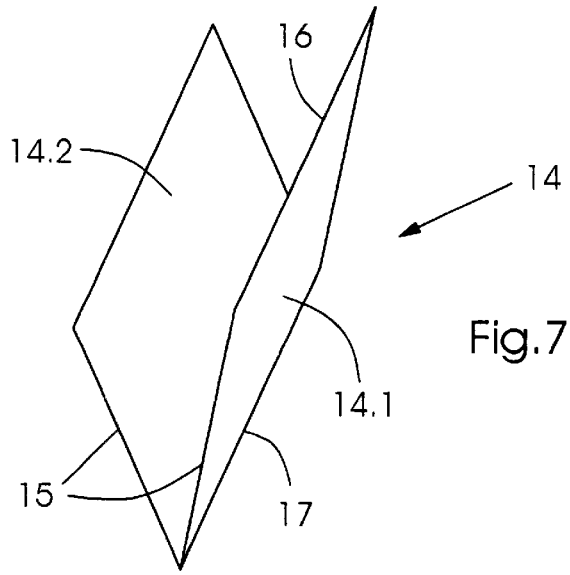
Fig.7.3

DEVICE FOR CONTINUOUS FOLDING OF FLAT MATERIAL

BACKGROUND INFORMATION

1. Field of the Invention

The present invention is related to a device for continuous folding of flat material such as signatures severed from a web of material in a folding apparatus assigned to a rotary printing press.

2. Background of the Invention

British Patent Publication No. 2 098 587 A discloses a signature transfer device in folder for a rotary printing press. Such a device includes a plurality of adjustable pressure rollers for holding down upper tapes to prevent the tapes from slipping on a signature while the signature is being transferred towards a position in which it will be folded on itself by a blade. Also, a mechanism is included acting on rollers for adjusting gaps between the upper tapes and the lower tapes to regulate the force with which the signature is sandwiched between the tapes in dependence of the number of pages or the thickness of the respective sheets. With these arrangements, the signature is prevented from getting wrinkled upon abutment against the front lays and from being skewed with respect to the blade when the signature arrives at the respective folding position.

U.S. Pat. No. 3,961,783 discloses an endless belt folder. In this configuration a folder apparatus includes an endless grooved belt mounted for movement along a linear folding path, opposite a second endless belt which is V-shaped in cross section. Said second endless belt interacts with the groove of the second belt thereby creating a fold in sheet material therebetween.

European Patent No. 0 434 987 B1, corresponding to U.S. Pat. No. 5,037,365, which hereby is incorporated by reference herein, discloses a folder with belt speed control. With this configuration a first longitudinally extending diverter means is disposed on a first side of the fold line and extends from the inlet section to the outlet section of said folder for deflecting sheet material projecting beyond an area on the first side of the fold line in a first direction as it moves from the inlet section to the outlet section of the folder. A second longitudinally extending diverter means is disposed on a second side of the fold line and extends from the inlet section to the outlet section of the folder, for deflecting sheet material projecting beyond an area on the second side of the fold line in the first direction as it moves from the inlet section to the outlet section of the respective folder. The first and second diverter means have diverter surfaces for gripping areas of the sheet material which increase as the sheet material moves away from the inlet section towards the outlet section of the folder.

A first arrangement of belts is provided at least partially disposed between said first and second diverter means gripping and moving sheet material along said first and second diverter means in a direction away from the inlet section towards the outlet section of the folder. Further, a second arrangement of belts at least partially is disposed between said first and second diverter means for gripping sheet material while it is being held and moved by the first arrangement of belts towards said outlet section of said folder. Consequently, said second arrangement of belts can grip and move the sheet material along the first and second arrangement away from the first arrangement of belts and towards the outlet section of said folder after said sheet material has separated from the first arrangement of belts.

Drive means are assigned to at least one of the belts of said first and second arrangement of belts for varying the running speed. A first signal generator means is provided for generating a first speed signal which is a function of the speed of said first arrangement of belts, a second signal generator means are provided to generate a second speed signal which is a function of the running speed of at least one belt in said second arrangement of belts. Finally a control means is provided for comparison of the first and second speed signals and for effecting operation of said drive means in order to vary the running speed of at least one of said belts in said arrangement of belts in response to a change in relationship between said first and second speed signal are provided.

In general, chopper folding means according to British Patent Publication No. 2 098 587 are speed limited in such a way that two are usually required to support one rotary printing press. Due to this requirement, auxiliary devices such as diverters or slow down sections or integrators also have to be added into the folder arrangement. Besides of being costly additions to the folder, these auxiliary devices also increase the risk of fold inaccuracies on their own inherent dynamic interactions with the signatures as they pass through each auxiliary section. Said belt assemblies according to U.S. Pat. No. 3,961,783 and European Patent No. 0 434 987 B1 are quite space consuming with respect to the placement of said folding arrangements.

SUMMARY OF THE INVENTION

In view of the drawbacks coming along with the above presented solutions according to the prior art and having sketched the difficulty generally encountered within the technical field it is accordingly one objective of the present invention to eliminate the need for chopper folding mechanisms.

A further alternate or additional object of the present invention is to eliminate the need for auxiliary equipment requirements.

A still further alternate or additional object of the present invention is particularly to eliminate the change in direction required to make a fold as necessary with chopper mechanisms.

According to the present invention, a device for continuous folding of flat material includes:

a driven rotating body arranged perpendicular to the conveying direction of flat articles, said rotating body rotating about its rotation axis, and surface sections assigned to the rotating bodies circumference tapered towards each other upon revolution of the respective cylinder.

The advantages according to the present invention reside in the facts that by driving a signature having one or more layers through the tapered surface portions of said folder rolls, a lineal fold is created, eliminating the change of direction required while stopping to make a fold as with well known chopper fold mechanisms. With the solution according to the present invention chopper fold mechanisms requiring numerous auxiliary equipment could be eliminated while creating a longitudinal fold upon the signatures being conveyed in conveying direction.

According to further advantageous embodiments according to the present invention said tapered surface sections, respectively, tapered towards each other at the same rate. Consequently the width of a V-shaped aperture between the surfaces arranged on the respective rotating body such as a cylinder narrows continuously upon revolution of said cylinder. Said tapered surface sections, respectively, form said V-shaped opening. The respective V-shaped opening's width is dependent upon the angle of rotation of said tapered surface section. Thus, the degree of fold applied to the respective flat articles such as one-layered or multi-layered signatures is dependent on the respective angle of rotation of said surface sections arranged on said cylinder.

Said surface sections are arranged mirrored about a center mid point axis and form a respective three dimensional spiral, which advantageously is shaped as an Archimedean spiral to apply a longitudinal fold on the respective signatures. The configuration of said tapered surface sections arranged on the circumference of said cylinder form a folder roller.

Said folder roll is made of metal or plastic or a composite of these materials; other suitable materials are wood or a weldment construction.

The fold roll—having substantially spirally shape—may be made of a series of varying taper brushes said folder roll may have tapered surface sections made of guide portions arranged on the circumference of said cylinder.

Said cylinder has surface sections assigned thereto arranged so as to create a vertically upward directed longitudinally folded product. In a first configuration of the folder rolls said folder rolls have a mid portion in which the fold seam substantially is placed to create a longitudinal fold upon further rotation of said spiral, preferably an Archimedean spiral. The respective folder rolls may be arranged perpendicularly to the conveying direction of the flat articles. In a further advantageous embodiment, said folder rolls are oriented so as to create a horizontally extending fold on the left or right side, this may be chosen taken into account individual requirements of the respective print shop.

Said folder roll may be arranged to as to form a downward oriented fold in the respective signature so as to form a folded signature. Said folder roll including tapered surface sections arranged on a cylinder may comprise tapered surface sections terminating at each angle between 0° and 360° upon a complete revolution of said cylinder. Said tapered surface sections may have abutting portions to allow for an alignment of the signatures to be longitudinally folded.

To maintain the signatures in the centered recess during conveyance in conveying direction which upon further rotation of said folder rolls gradually narrows and to provide for a higher accuracy of the longitudinal fold, creaser means such as creaser belts, air nozzles, rotating knives or the like may be provided, assigned to the respective path of signature travel in conveying direction.

To provide for a higher effectiveness of the folding operation with said tapered surface sections assigned to said cylinder, said folder rolls may be arranged in the series configuration one arranged behind the other in inclined orientation to perform a horizontally extending path or below said signatures' transporting path to provide for a longitudinally folded signature on the respective signatures spine.

The dynamic linear folding roll according to the present invention may be arranged in folder apparatuses either having retractable pin arrangements to seize the multi-layered signatures or in the alternative, said dynamic linear folding rolls may be provided in a pinless folder apparatus, at least one of said above mentioned folders being assigned to a web fed rotary printing press for commercial or newspaper printing.

BRIEF DESCRIPTION OF THE DRAWINGS

The novel features with are considered as characteristic for the invention are set forth in particular in the appended claims. The invention itself, however, both as to its construction and its method of operation together with additional objects and advantages thereof, will be best understood from the following description of a specific embodiment, when read in connection with the accompanying drawings, in which:

DETAILED DESCRIPTION

Figure 1:
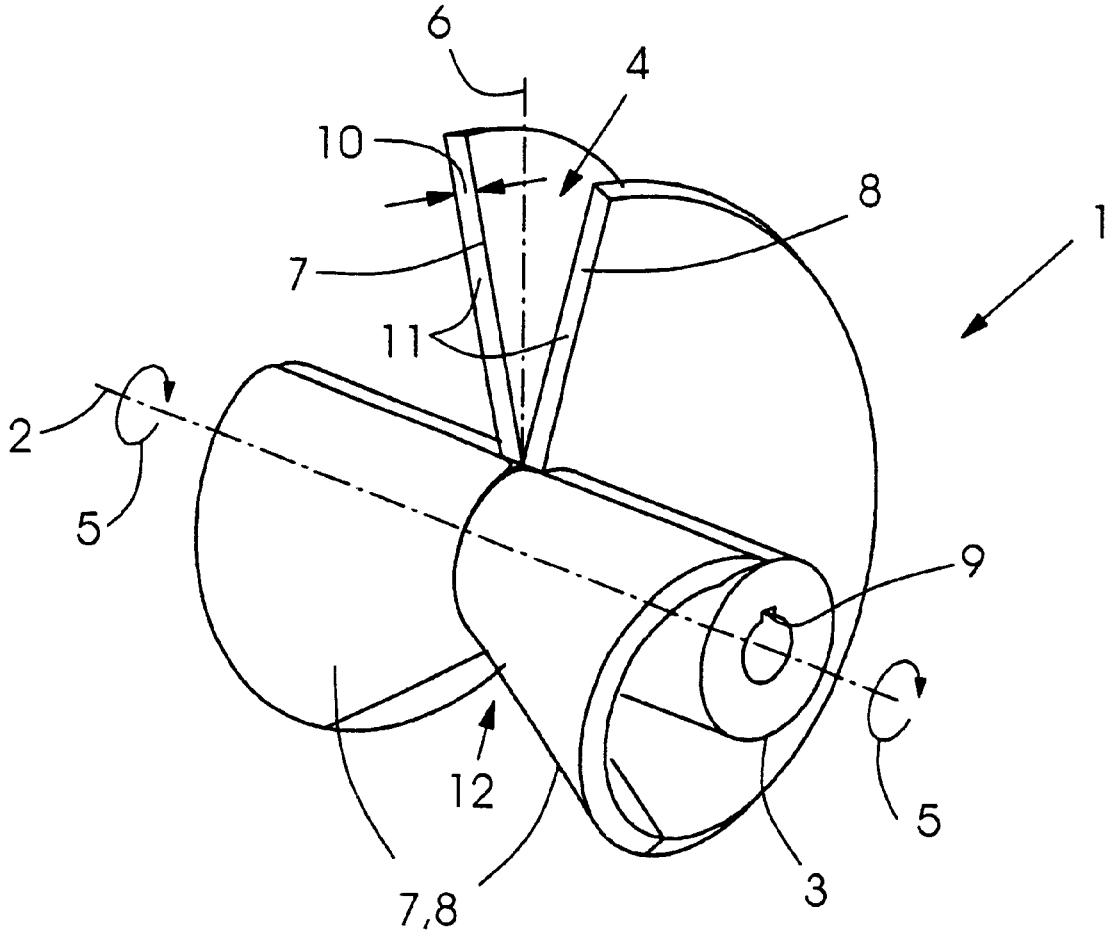
FIG. 1 shows a folder roll according to the present invention tapered surface sections arranged upon respective cylinder's circumference.

FIG. 1 represents a perspective view of a folder roll according to the present invention, tapered surface sections arranged upon a respective cylinder's circumference.

A folding roll 1 according to the present invention includes a rotating body 3 such as a cylinder, provided with a bore about which said cylinder 3 turns in the sense of rotation indicated by arrow 5. On the respective outer circumference of the cylinder 3 two surface sections 7, 8 are arranged, forming a V-shaped aperture 12 therebetween. Upon rotational movement of said folding roll 1 about an axis of rotation 2 in the sense of rotation 5 said V-shaped aperture 12—formed by respective tapered surface sections 7, 8, respectively—closes gradually. Thus, during a 360°-revolution about its respective center axis 2 said tapered surface sections are turned such that upon passage of a respective signature 14 to be longitudinally folded on the respective tapered surface sections 7, 8, respectively, the longitudinally fold 17, 24 (see e.g. FIG. 3) can be imposed on the respective signature 14 upon one revolution of said folding roll 1 about its respective center axis 2.

Furthermore, the respective folder roll 1 includes abutting portions 11, for alignment of the respective signature's 14 position prior to being longitudinally folded upon rotation of the driven folding roll 1. The respective tapered surface sections 7, 8, respectively, are mirrored about a center axis mid point 6. Said surface sections 7, 8, respectively, are arranged symmetrically with respect to the centerline. The respective surface sections 7, 8, respectively, are preferably shaped as three dimensional spirals, more preferably as Archimedean spirals arranged on the respective outer circumference of a rotating body 3 such as a cylinder. Said cylinder 3 is driven, consequently said center axis 2 extending therethrough comprises a key-engaging nut 9.

Figure 2:
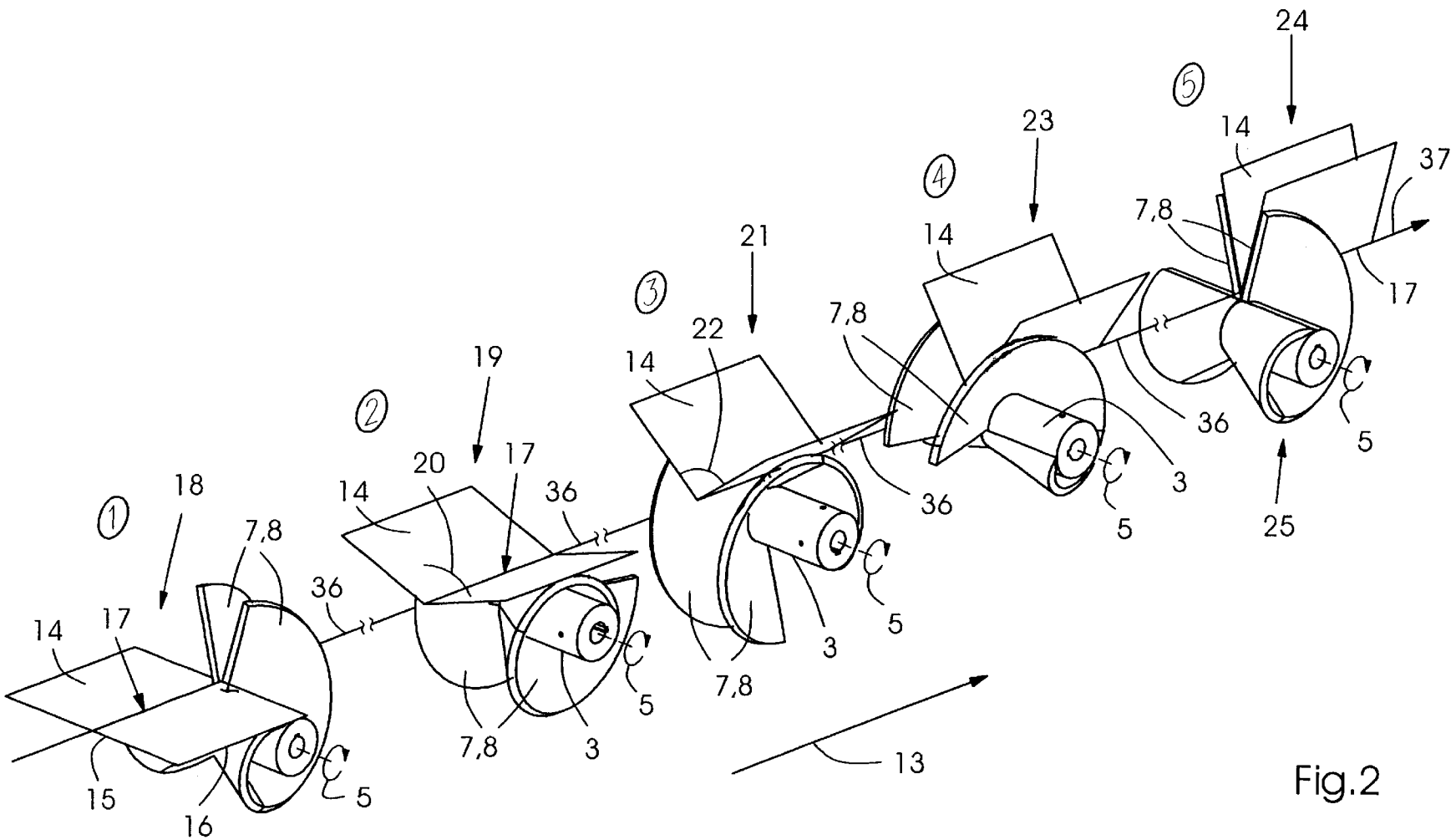
FIG. 2 shows a stepwise folding operation on a respective signature, said folding rolls turning about the respective center axis.

FIG. 2 shows a stepwise folding operation on a respective signature performed on a folding roll according to the present invention.

At the very beginning of the folding operation along said fold progression 13, said signature 14 adopts a flat stage, identified by reference numeral 18. In this stage 18 said signature 14 to be longitudinally folded about fold seam 17 abuts said alignment portions 11 of said tapered surface sections 7, 8, respectively. Seized along its fold seam 17 by a schematically given creaser means 36, said signature's width 15 is oriented such that said fold seam 17 corresponds to the respective center of said tapered surface sections 7, 8.

In a second folding stage 19 depicted in FIG. 2 of the present application said folding roll 1 is rotated by an angle of rotation in the sense of rotation 5 about its respective axis of rotation 2. Consequently, said tapered surface sections 7, 8 have risen for some degree and begin to fold the respective side portions neighboring fold seam 17 of said signature 14. Said movement of said side portions of the signature 14 is identified by said folding angle 20, in this stage less than 180°. By said creaser means 36, only schematically given here, said signature's 14 center is maintained centered towards said tapered surface sections 7, 8, respectively, to allow for positioning of said signature's 14 folding spine, in the center of said V-shaped aperture 12 between said tapered surface sections 7, 8, respectively.

In a third stage 21 along said fold progression 13 said portions of said signature 14 neighboring said fold seam 17 have moved closer towards each other, since upon further revolution of said folding roll 1 said tapered surface sections 7, 8, respectively, begin to rise. Consequently, said side portion of said signature 14 will rise accordingly, moving gradually towards each other, said fold seam 17 seized by respective creaser means 36 shown schematically here only.

A fourth stage 23 of folding along said fold progression 13 shows the respective folding roll 1 having rotated approximately about 270°, thus, having almost finished a respective longitudinally fold within the signature 14. Upon further rotation of the respective folding roll 1 said signature 14 has received a vertically upward extending longitudinal fold being conveyed in conveying direction 37 being kept to the respective groove by respective creaser means 36 seizing said folding seam 17.

The final stage 25 given here shows a longitudinally folded signature 24 having its respective spine being seized by said creaser means 36 upon signature's 14 traveling and conveying direction 37.

In the example given here in connection with FIG. 2, Archimedean spirals are used as tapered surface sections 7, 8, respectively. There may be other spiral creating techniques used to have spiral of any diameter created to perform a longitudinal fold. Said tapered surface sections 7, 8, respectively, may be made of metal, plastics or a composite thereof; a weldment configuration or wooden surfaces are conceivable as well.

The respective creaser means 36 engaging the respective fold seam 17 of said signature 14 to be conveyed, may be shaped as fixed blades, air nozzles, brushes, or belts, or disk-shaped elements for maintaining the respective fold seam 17 of said signatures 14 on the bottom of said V-shaped opening 12 to guarantee high folding accuracy.

Figure 3:
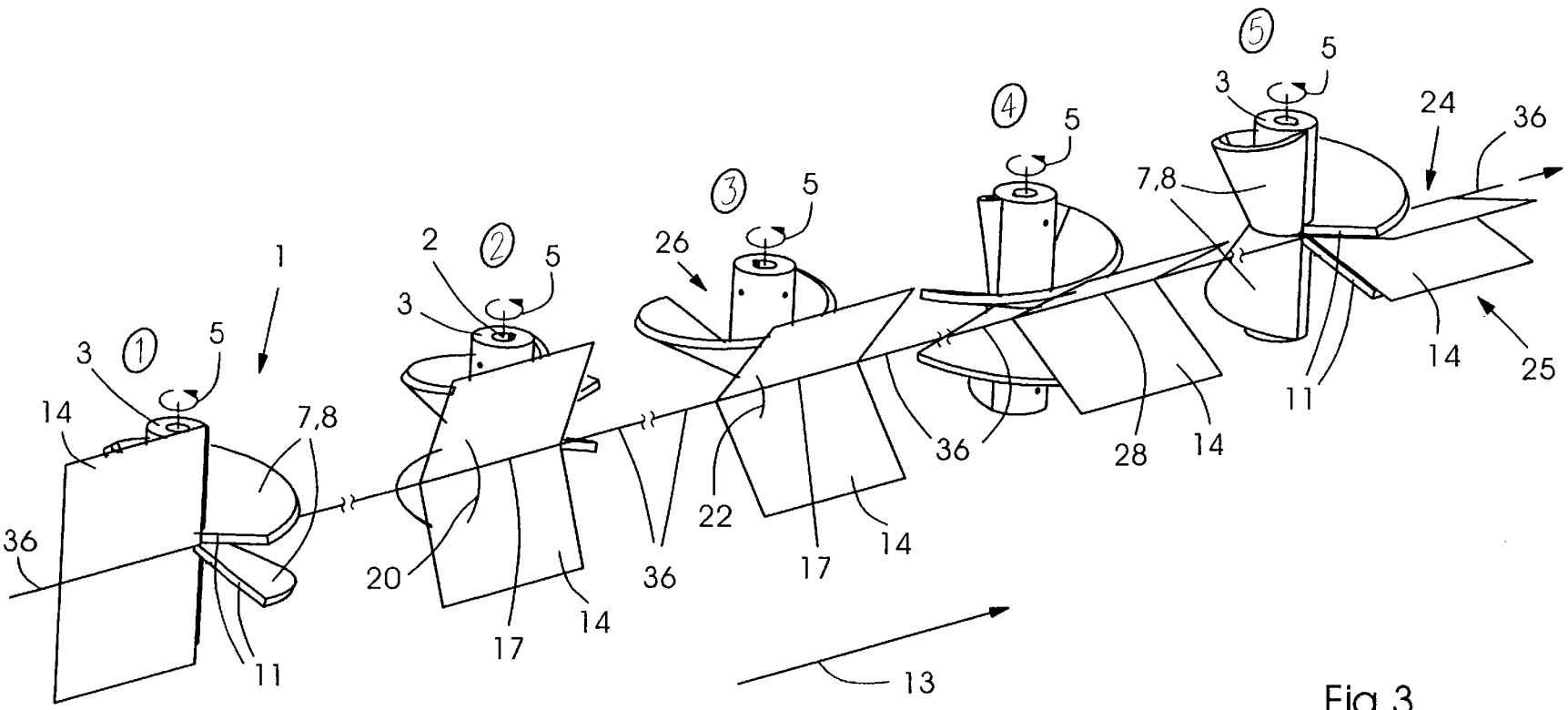
FIG. 3 represents a folding roll arranged in a position to apply longitudinally extending folds on a respective signature.

FIG. 3 represents a folding roll arrangement arranged in a position to apply longitudinally extending folds on a respective signature's side.

In this configuration, along a folding progression 13, several stages of folding progress on respective signature 14 are shown. In the configuration given here said folding rolls 1 are oriented in an upright position to create a fold in a signature 14, extending in horizontal direction. In the initial stage said signature 14 abuts said abutting portion 11 of said spirally shaped surfaces 7, 8, respectively. Said signature 14 is seized about its center axis 35 and will upon common movement of said folding roll 1 about the respective center axis 2 gradually be folded in longitudinal direction, parallel to the conveying direction indicated by reference numeral 37. Said folding angle 20 gradually decreases upon further rotation of said tapered surface sections 7, 8, respectively. Consequently, both sides of a respective signature 14 taper in towards each other—preferably at the same rate—folding said signature's 14 spine. In the configuration depicted in FIG. 3 a horizontally extending fold is created on the left hand side of said signature. A longitudinal fold on the right hand side thereof is conceivable as well.

Figure 4:
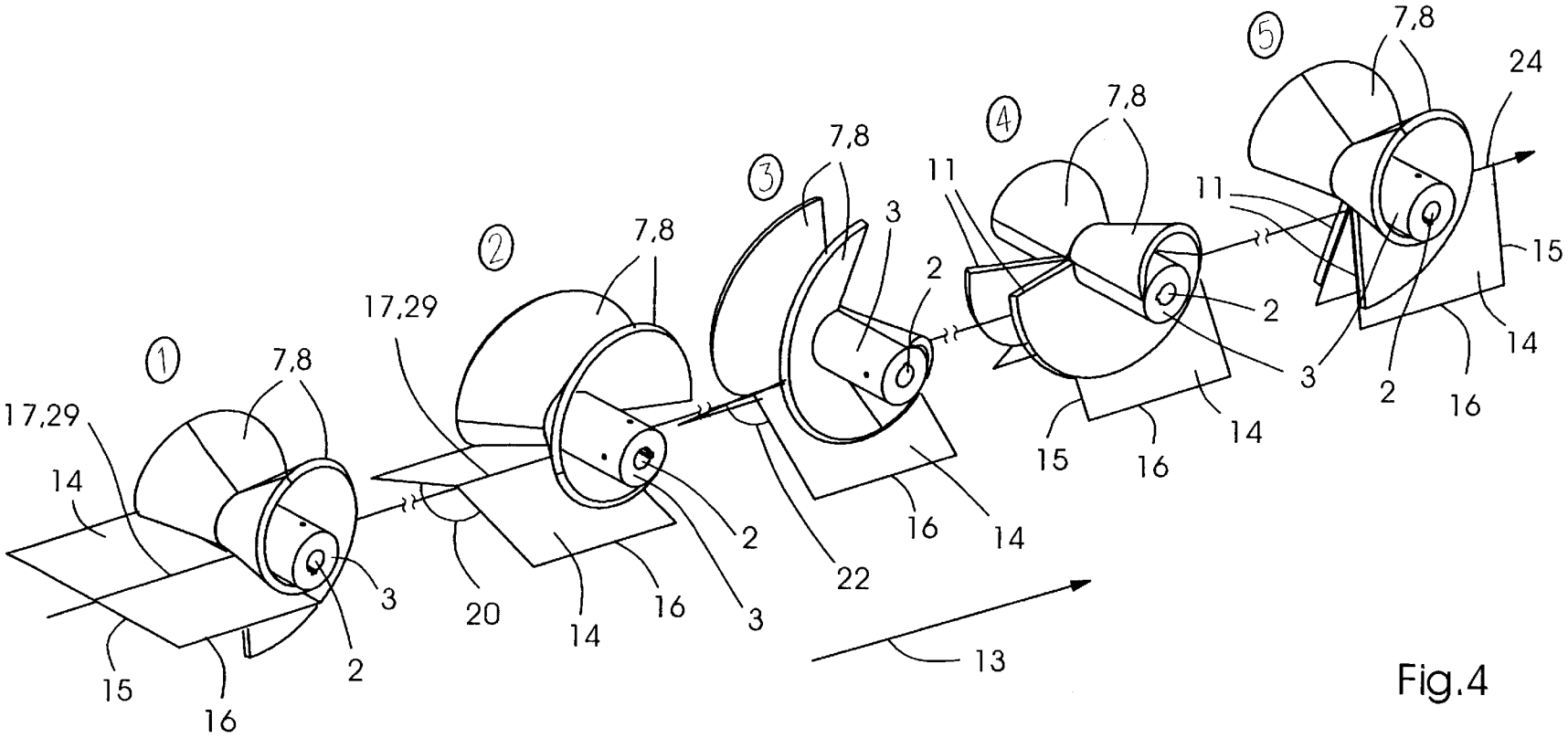
FIG. 4 shows a folding roll arrangement assigned to a respective signature travel path, to create a vertically downward oriented fold.

FIG. 4 shows a folding roll arrangement assigned to a respective signature's travel path said signature receiving a fold been oriented vertically downward.

The folding roll arrangement according to FIG. 4 is the same as the previously described folding roll arrangement in connection with FIG. 1. Turned about 180°, i.e. folding roll 1 is being arranged above said signature 14 to be longitudinally folded. Said fold seam 17 having a vertical downward oriented fold, continuously be folded upon rotation of said fold roll 1 about its respective center axis 2. Said tapered surface sections 7, 8, respectively, will impose a gradually longitudinal fold upon said signature 14 when moved through the respective width of said V-shaped opening the width of which depends upon a rotational stage of said driven cylinder 3.

Having turned about approximately 360° about its respective center axis 2 said vertically downward extending fold 24 is created in the signature 14, the respective open edges of said signature 14 oriented downwards. Said signature 14—although not shown here in greater detail—is received upon creaser means 36 such as a disk, a belt, a chain, or other elements, to maintain said fold seam 17 centered within said tapered surface sections 7, 8, respectively.

Figure 5:
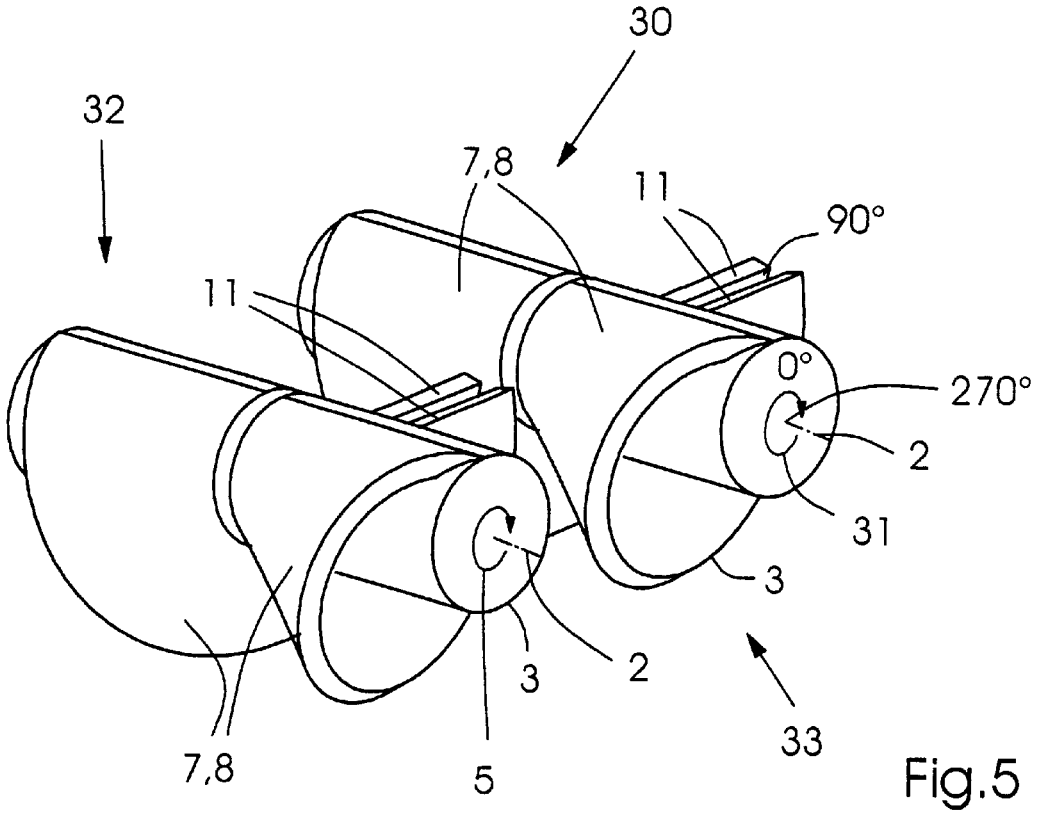
FIG. 5 shows a series arrangement of a folder roll assembly according to the present invention.

FIG. 5 shows an arrangement in series of said folding rolls.

In this configuration, said folding rolls 1 are arranged in series, including a first spiral 32 and a respective second spiral 33. Said abutting portions 11 aligning a leading edge of a respective signature 14 to be longitudinally folded are rotated into a 90° position. Said tapered surface sections 7, 8, respectively, assigned to the respective cylinders 3 may be shaped such that they terminate at any angle between 0° and 360° of cylinder rotation in sense of rotation 5 about center axis 2. This offers a large variety of fold characteristics or product sizes to take into account the individual folding requirements, i.e. the escape of entrapped air upon folding of a multi-layered signature etc.

Figure 6:
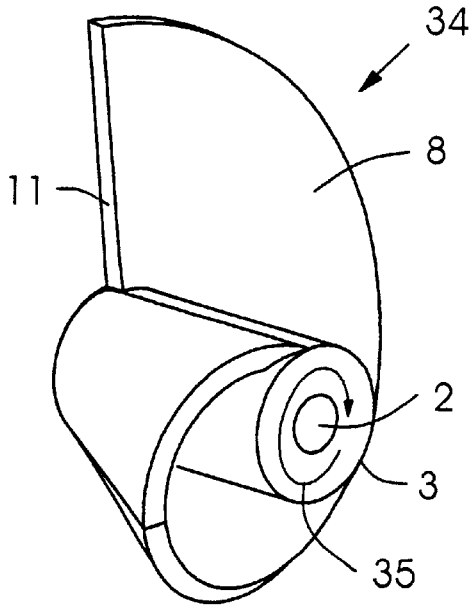
FIG. 6 shows a perspective view of a single Archimedean spiral, and FIGS. 7.1, 7.2 and 7.3 show a folding arrangement, folding respective signature portions by ½ of a folder roll.

FIG. 6 shows a perspective view of a single folding roll.

In this configuration of a single spiral 34, the three dimensional shape of said tapered surface section 8 is further clarified. Said single spiral 34 represents one half of a respective cylinder 3 rotating about a center axis 2 in the sense of rotation indicated by arrow 5. It may be coated with a marking preventing or elastic coating to prevent signatures from marking upon rotational movement of said single spiral 34 about axis 2. Said tapered surface sections 7, 8, respectively, narrow upon rotation more and more in a width to close a V-shaped aperture 12 being formed between two tapered surface sections 7, 8, respectively, arranged in a narrowing configuration on a respective cylinder's 3 circumference.

FIGS. 7.1, 7.2 and 7.3, respectively, show the subsequent folding of respective signatures portions on both sides of a folding seam.

While a respective half of said signature 14 is secured in belts 38, the respective other half of said signature is folded by a single spiral 34 as shown in FIG. 6. Thus, the free half of said signature will move upwardly into folding direction 39.

In FIG. 7.2 the upwardly folded half of said signature is seized by belts 38, whereas the free and portion will move upward by said single spiral 34 as given in FIG. 6. Consequently, a V-shaped finished signature 14 according to FIG. 7.3 is created, by having a respective first half 14.1 folded while the other half 14.2 is secured, and a respective second half 14.2 is folded having the first half 14.1 secured in belts 38.

REFERENCE NUMERAL LIST

1 folding roll
2 center axis
3 cylinder
4 opening
5 sense of rotation
6 center axis mid point
7 first tapered surface
8 second tapered surface
9 key engaging section
10 thickness
11 abutting portion
12 rotational dependent V-shaped aperture
13 fold progression
14 signature
14.1 first half
14.2 second half
15 width
16 length
17 folding seam
18 flat stage
19 second stage
20 folding angle
21 third stage
22 folding angle
23 fourth stage
24 longitudinally folded signature
25 final stage
26 inclined position
27 second orientation
28 horizontal fold
29 vertical downward fold
30 series arrangement
31 3/4-section
32 first spiral
33 second spiral
34 single spiral
35 sense of rotation
36 creaser means
37 conveying direction
38 holding belts
39 folding direction

What is claimed is:

1. A device for continuous folding of flat material having a conveying direction comprising:

a driven rotating body arranged perpendicular to the conveying direction, the rotating body rotating about a rotation axis and having a circumference; and surface sections assigned to the circumference tapering towards each other upon revolution of the rotating body.

2. The device according to claim 1, wherein said surface sections taper towards each other at a same rate.

3. The device according to claim 1, wherein said surface sections, respectively, form a V-shaped aperture therebetween.

4. The device according to claim 3, wherein said V-shaped aperature has a width, the width being dependent upon an angle of rotation of said tapered surface sections, respectively.

5. The device according to claim 1, wherein said surface sections, respectively, are arranged mirrored about a center mid point axis.

6. The device according to claim 1, wherein said surface sections, respectively, form two cooperating three dimensional spirals.

7. The device according to claim 6, wherein said three dimensional spirals are Archimedean spirals.

8. The device according to claim 1, wherein said tapered surface sections, respectively, and said rotating body form a folder roll.

9. The device according to claim 8, wherein said folder roll is made of metal or plastic or a metal/plastic-composite.

10. The device according to claim 8, wherein said folder roll is made of wood or a weldment.

11. The device according to claim 8, wherein said folder roll is made of a series of varying taper brushes.

12. The device according to claim 8, wherein said folder roll is made by a series of guides arranged on the circumference of said cylinder.

13. The device according to claim 8, wherein said folder roll comprises surface sections, respectively, terminating at an angle between 0° and 360° of a revolution of the rotating body.

14. The device according to claim 8, wherein said fold rolls are arranged in series along said conveying direction.

15. The device according to claim 1, wherein the rotating body is arranged so as to create a vertically upward oriented longitudinally folded product.

16. The device according to claim 1, the rotating body is oriented in an inclined orientation with respect to the conveying direction so as to create a horizontal fold.

17. The device according to claim 1, wherein the surface sections are oriented in a position so as to allow for a vertically downward oriented fold in the flat material.

18. The device according to claim 1, wherein the flat material to be folded about a fold seam are centered towards a V-shaped opening aperture by a creaser.

19. The device according to claim 1, wherein said flat material to be folded about a fold seam is centered towards a V-shaped opening aperture by creaser belts.

20. The device according to claim 1, wherein said flat material to be folded about a fold seam are centered towards a V-shaped opening by airjets extending air nozzles.

21. The device according to claim 1, wherein a respective half of said signature is folded by a single spiral by having the respective other half of said flat material secured in holding elements.

22. The device according to claim 21, wherein a respective folded half is secured by holding elements in its upward orientation, while the other half is folded by a single spiral.

23. The device according to claim 1, wherein the rotating body is a cylinder.

24. A folder apparatus having a device for continuous folding of flat material having a conveying direction comprising:

a driven rotating body arranged perpendicular to the conveying direction, the rotating body rotating about a rotation axis and having a circumference; and surface sections assigned to the circumference tapering towards each other upon revolution of the rotating body.

25. A pinless folder apparatus having a device for continuous folding of flat material having a conveying direction comprising:

a driven rotating body arranged perpendicular to the conveying direction, the rotating body rotating about a rotation axis and having a circumference; and surface sections assigned to the circumference tapering towards each other upon revolution of the rotating body.

26. A rotary printing press having a folder apparatus including a device for continuous folding of flat material having a conveying direction comprising:

a driven rotating body arranged perpendicular to the conveying direction, the rotating body rotating about a rotation axis and having a circumference; and surface sections assigned to the circumference tapering towards each other upon revolution of the circumference.

* * * * *